United States Patent [19]

Belmondo

[11] Patent Number: 4,648,505

[45] Date of Patent: Mar. 10, 1987

[54] HOLDER FOR A NUMBER OF WRITING IMPLEMENTS

[75] Inventor: Domenico Belmondo, Mappano, Italy

[73] Assignee: Dobell S.a.s. di Domenico Belmondo & C., Mappano-Borgaro Torinese, Italy

[21] Appl. No.: 810,757

[22] Filed: Dec. 19, 1985

[30] Foreign Application Priority Data

Dec. 21, 1984 [IT] Italy ..... 54213/84[U]

[51] Int. Cl.[4] ..... B65D 85/28

[52] U.S. Cl. ..... 206/214; 206/224; 206/372; 206/443; 206/564

[58] Field of Search ..... 206/214, 224, 234, 443, 206/564, 366, 370, 369, 372

[56] References Cited

U.S. PATENT DOCUMENTS

| | | | |
|---|---|---|---|
| 1,043,333 | 11/1912 | McCully | 206/370 |
| 1,266,091 | 5/1918 | Basch | 206/234 |
| 1,292,252 | 1/1919 | Carrier | 206/369 |
| 1,495,443 | 5/1924 | Rosser | 206/369 |
| 2,228,493 | 1/1941 | Will | 206/223 |
| 3,923,152 | 12/1975 | Minneman | 206/443 |

FOREIGN PATENT DOCUMENTS

| | | | |
|---|---|---|---|
| 2404458 | 9/1975 | Fed. Rep. of Germany | 206/443 |
| 966523 | 10/1950 | France | 206/234 |
| 2075429 | 11/1981 | United Kingdom | 206/214 |

*Primary Examiner*—William Price
*Assistant Examiner*—Brenda J. Ehrhardt
*Attorney, Agent, or Firm*—Shlesinger Arkwright Garvey & Fado

[57] ABSTRACT

Holder for a number of writing implements, comprising first means for housing in parallel manner at least a portion of the said implements, and reusable second means for containing the said first means, the latter ensuring the said implements are housed in essentially stable manner regardless of the position of the said first means.

7 Claims, 5 Drawing Figures

1
2
3
4
5
7
8
9
10
12
13
14
15
16
17
18
20

HOLDER FOR A NUMBER OF WRITING IMPLEMENTS

BACKGROUND OF THE INVENTION

The present invention relates to a holder for a number of writing implements, in particular, of various colours, such as felt pens.

Holders of the aforementioned type are currently known to consist of a shaped body, usually made of plastic and defining a number of parallel grooves for simply supporting a portion of the said writing implements. A U-shaped cardboard is then simply placed over a front section and folded about the rear of the said shaped body, and the whole inserted inside a hang-up plastic bag, the latter being transparent only at the front, so as to reveal the short sections, usually coloured, of the said writing implements left uncovered at the front by the said cardboard.

Holders of the aforementioned type present a number of drawbacks. First and foremost, the said writing implements simply rest inside the grooves on the said shaped body, so that, when the latter is removed from the plastic bag, the said implements easily tumble out of the grooves into a disorderly pile. Such a drawback is further aggravated by the fact that the cardboard is not secured to the said shaped body.

SUMMARY OF THE INVENTION

The aim of the present invention is to provide a holder for a number of writing implements involving none of the aforementioned drawbacks, i.e. one enabling the said implements to be removed from the outermost holder while at the same time remaining firmly and orderly lodged inside their respective compartments, and which lends itself more readily to automated mass production.

Further aims and advantages of the holder according to the present invention will be disclosed in the forthcoming description.

With this aim in view, the present invention relates to a holder for a number of writing implements, comprising first means for housing in parallel manner at least a portion of the said implements, and reusable second means for containing the said first means, characterised by the fact that the said first means ensure the said implements are housed in essentially stable manner regardless of the position of the said first means.

BRIEF DESCRIPTION OF THE DRAWINGS

A non-limiting arrangement of the present invention will now be described with reference to the attached drawings in which.

DETAILED DESCRIPTION OF THE INVENTION

Figure 1:
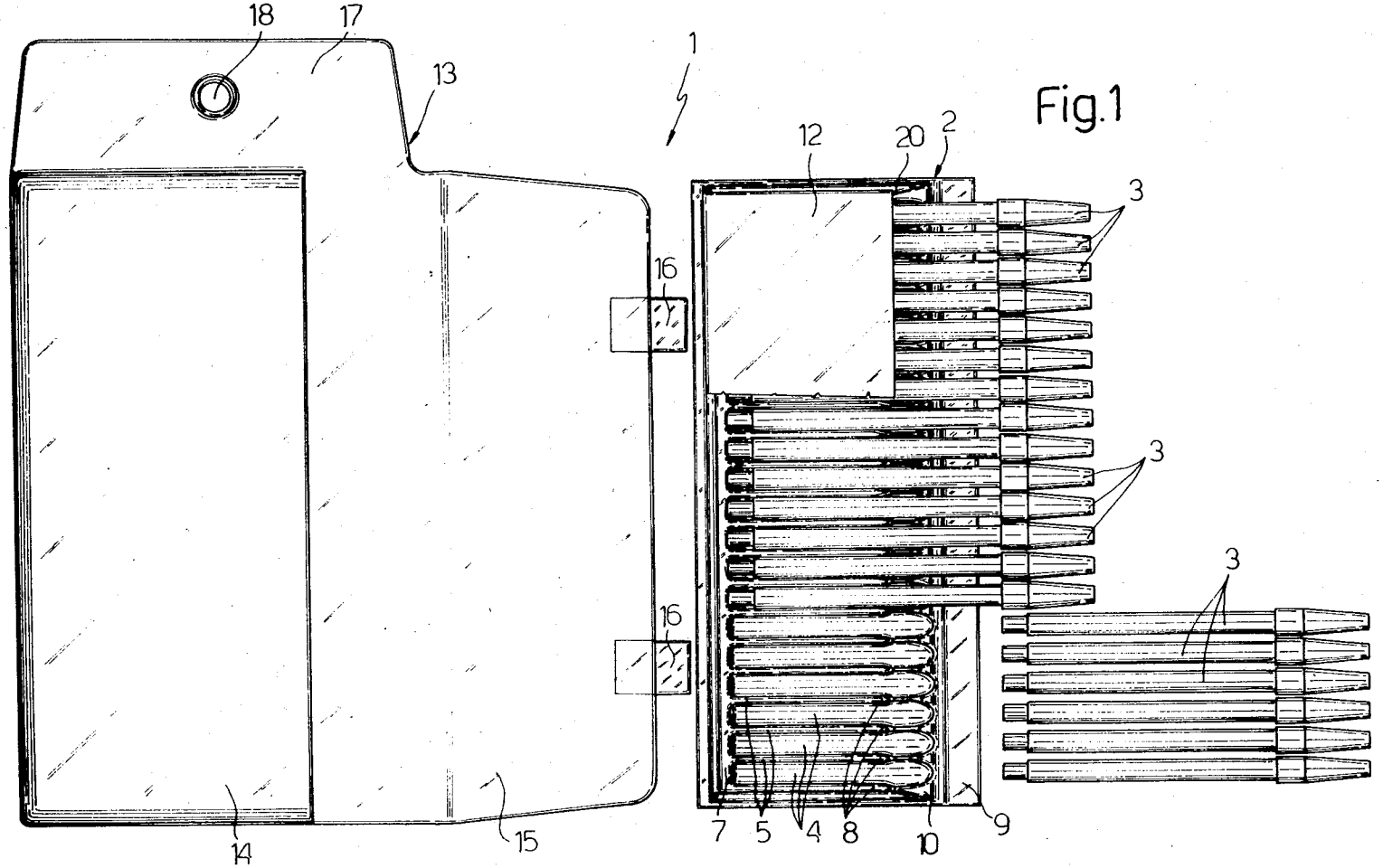
FIG. 1 shows a partially-sectioned breakdown of the holder according to the present invention.
Figure 3:
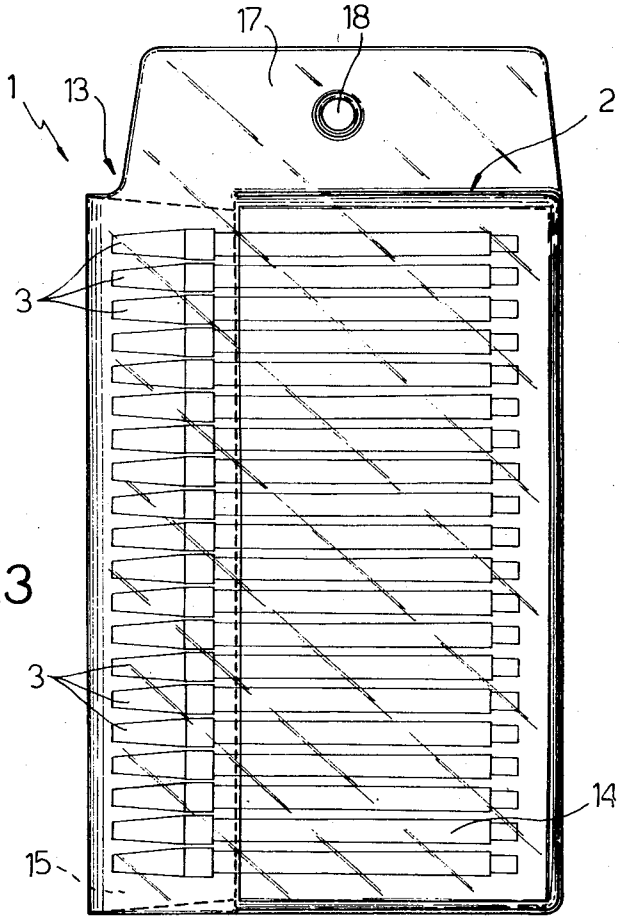
FIGS. 2 and 3 shows a front and rear view respectively of the FIG. 1 holder.

Number 1 in FIGS. 1 to 5 indicates a holder according to the present invention and comprising a shaped body 2 conveniently made of transparent plastic and conveniently vacuum formed, for housing in parallel manner a substantial end portion of writing implements 3, the latter conveniently being felt pens of various colours. In more detail, the said shaped body 2 presents an essentially rectangular contour and defines, crosswise in relation to its longer axis, a number of essentially U-section (FIG. 5) parallel grooves 4 forming compartments in which to house in essentially stable manner the said writing implements 3. In more detail, the said grooves 4 provide for slightly forced accommodation of implements 3, in that the inside clearance between dividing walls 5 is slightly less than the diameter of the said implements 3. The said shaped body 2 presents a continuous bottom wall 7 closing off one end of grooves 4, while, at the other open end, dividing walls 5 present end portions of decreasing height 8 and shaped body 8 presents an endpiece 9 with an initial upcurved section 10. The top edges of dividing walls 5 are fitted with a rectangular sheet 12 narrower than shaped body 2 and conveniently consisting of a sheet of cardboard bearing appropriate printing and graphics and which is secured to body 2 by known technical means, e.g. by electronically welding the plastic and board portions. The said cardboard sheet 12 may conveniently be precoated with a hot-glueing substance. The assembly consisting of shaped body 2 fitted with rectangular sheet 12 and felt pens 3 arranged inside parallel grooves 4 is inserted inside holder 13 conveniently made of transparent plastic and comprising a pocket portion 14, a flap portion 15 designed to fold over pocket portion 14 and having ripoff adhesive fasteners 16, and a top portion 17 with a hang-up hole 18.

The holder 1 according to the present invention is employed as follows.

Figure 2:
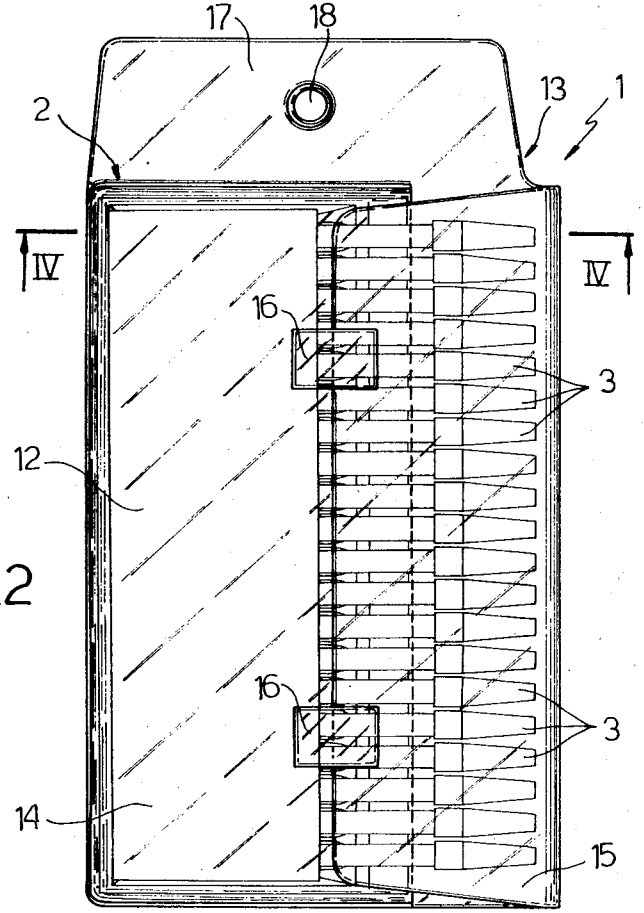
Figure 5:
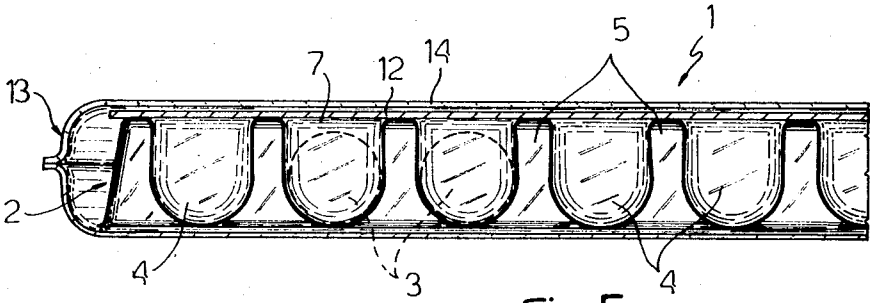
FIG. 5 shows a part section along line V—V of the FIG. 4 holder.

Felt pens 3 are slightly force fitted inside parallel grooves 4 on shaped body 2, the said grooves 4 also being fitted with rectangular sheet 12 for better defining the housing compartment, and the resulting whole then inserted inside pocket portion 14 on holder 13, over which portion 14 flap 15 is then folded. So arranged, felt pens 3 and the full colour range of the same are visible through the front of holder 13 (the section left uncovered by rectangular sheet 12, as shown in FIG. 2), as well as being fully visible through the back of holder 13 (FIG. 3) by virtue of both holder 13 and shaped body 2 being made of transparent material. The user may therefore open holder 13, as required, and remove body 2, complete with implements 3, from pocket portion 14, the said body 2 being designed in such a manner that it may be handled as required with no danger of implements 3 being dislodged. The latter, in fact, may only be removed singly by the user exerting minimum intentional force and withdrawing them by the cap end from the free front portion. In like manner, the user may hold body 2 in one hand, like a paint palette, with no dislodgeable elements, and pick out and replace felt pens 3 of different colours as required. The holder 1 according to the present invention is also suitable for fully-automated manufacture, in that an automatic machine may be employed for producing body 2, positioning and securing rectangular sheet 12, inserting writing implements 3 and inserting the resulting whole inside holder 13 which may also be produced automatically.

Figure 4:
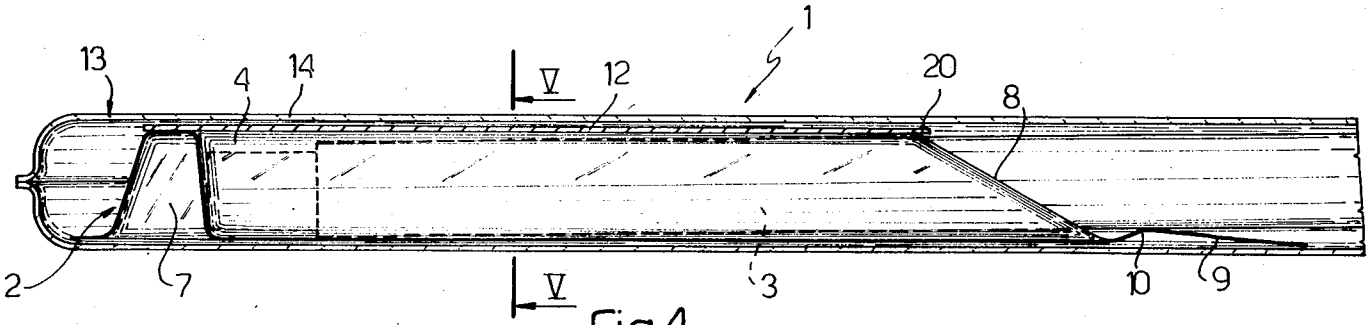
FIG. 4 shows a part section along line IV—IV of the FIG. 2 holder.

As shown in FIG. 4, the upcurved section 10 on endpiece 9 provides for slightly raising a centre portion of writing implement 3 which may thus essentialy contact an end section 20 of rectangular sheet 12 for further improving light force fitting of writing implements 3 inside grooves 4 on body 2.

Furthermore, the height of the said grooves 4 may be slightly less than that of implements 3, thus providing also (or exclusively) for force fitting implements 3 inside grooves 4.

To those skilled in the art it will be clear that changes may be made to the holder as described herein without, however, departing from the scope of the present invention. For example, the said writing implements 3 may also be ball-point pens, pencils, fine-tip felt pens, etc. ranging widely in number (e.g. 10, 20, 40, etc.) depending on the type of package required.

I claim:

1. A holder for a plurality of writing implements comprising:

(a) a shaped body member having a plurality of longitudinally extending grooves formed therein, said grooves being bordered by longitudinally extending dividing walls, (b) said grooves together with said dividing walls providing force-fit accomodation for proximal end portions of the writing implements, (c) said dividing walls having top edges, (d) a sheet member overlying a substantial portion of said shaped body member and secured to said body member at said top edges of said dividing walls, (e) said sheet member having a leading edge portion extending transversely across said shaped body member, (f) said shaped body member and said sheet member forming substantially enclosed compartments in which to house in parallel manner the proximal end portions of the writing implements, the distal end portions of the writing implements extending beyond the confines of said substantially enclosed compartments and being free and unobstructed for the purpose of withdrawal, (g) said shaped body member including a transversely extending ridge portion for engaging and slightly elevating the distal end portions of the writing implements forcing intermediate portions defined between the proximal and the distal end portions of the writing implements into abutting contact with said leading edge portion of said sheet member, thereby maintaining the proximal end portions of the writing implements securely situated within said grooves regardless of the inclination of said body member, and (h) a reusable close-up holder for containing said shaped body member.

2. A holder as in claim 1, wherein:

(a) said grooves are substantially U-shaped in cross-section, and (b) the inner clearance between adjacent dividing walls being slightly less than the width of said writing implements housed in said grooves.

3. A holder as in claim 1, wherein:

(a) said shaped body member and said reusable close-up holder are made of transparent material.

4. A holder as in claim 1, wherein:

(a) said sheet member is constructed of cardboard.

5. A holder as in claim 1, wherein:

(a) said shaped body member is made of plastic, and (b) said sheet member is electronically welded to said top edges of said dividing walls.

6. A holder as in claim 1, wherein:

(a) the writing implements are of various colors.

7. A holder as in claim 1, wherein:

(a) the writing implements comprise one or more felt pens, ball-point pens or pencils.

* * * * *